US008662789B2

(12) United States Patent
Ma

(10) Patent No.: US 8,662,789 B2
(45) Date of Patent: Mar. 4, 2014

(54) PAVER

(71) Applicant: Empire Technology Development LLC, Wilmington, DE (US)

(72) Inventor: Yuchen Ma, Shanghai (CN)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 14/039,854

(22) Filed: Sep. 27, 2013

(65) Prior Publication Data

US 2014/0030019 A1 Jan. 30, 2014

Related U.S. Application Data

(62) Division of application No. 13/254,970, filed as application No. PCT/CN2010/076122 on Aug. 19, 2010, now Pat. No. 8,579,543.

(51) Int. Cl.
*E01C 23/14* (2006.01)

(52) U.S. Cl.
USPC ..... 404/77; 404/79

(58) Field of Classification Search
USPC ..... 404/77, 79, 95
See application file for complete search history.

(56) References Cited

U.S. PATENT DOCUMENTS

| | | | | |
|---|---|---|---|---|
| 3,372,626 | A | 3/1968 | Smarzak | |
| 3,902,939 | A * | 9/1975 | Eigenmann | 156/71 |
| 5,333,969 | A | 8/1994 | Blaha et al. | |
| 6,093,247 | A | 7/2000 | Sipos et al. | |
| 6,109,826 | A | 8/2000 | Mertes | |
| 6,799,922 | B2 | 10/2004 | Smith | |
| 7,458,746 | B1 | 12/2008 | Zimmerman | |
| 7,874,763 | B2 | 1/2011 | Benedetti | |
| 8,579,543 | B2 * | 11/2013 | Ma | 404/95 |
| 2004/0161299 | A1 | 8/2004 | Smith | |
| 2009/0226256 | A1 | 9/2009 | Alain | |

FOREIGN PATENT DOCUMENTS

| | | |
|---|---|---|
| CN | 2482558 | 3/2002 |
| EP | 0 971 074 | 1/2000 |

OTHER PUBLICATIONS

International Preliminary Report on Patentability for Intl. Pat. Appln. No. PCT/CN2010/076122, issued on Feb. 19, 2013, 7 pp.
International Search Report and Written Opinion for PCT/CN2010/076122 mailed Jun. 2, 2011.
Non-Final Office Action for U.S. Appl. No. 13/254,970, mailed on Apr. 1, 2013, 8 pp.
Notice of Allowance for U.S. Appl. No. 13/254,970, mailed on Aug. 8, 2013, 13 pp.
Restriction Requirement for U.S. Appl. No. 13/254,970, mailed on Dec. 26, 2012, 5 pp.

* cited by examiner

*Primary Examiner* — Gary Hartmann
(74) *Attorney, Agent, or Firm* — Foley & Lardner LLP

(57) ABSTRACT

A paver includes an enclosed furnace for melting an inorganic paving material and a carriage for carrying the furnace. The furnace includes a heating chamber for receiving the paving material, a heater for heating the heating chamber to a temperature greater than 1,600° C. to melt the paving material, and an outlet for discharging melted paving material to form a paved road surface.

18 Claims, 7 Drawing Sheets

PAVER

CROSS-REFERENCE TO RELATED APPLICATIONS

This application is a divisional of U.S. patent application Ser. No. 13/254,970, filed on Sep. 6, 2011, which claims the benefit as a national stage of International Application No. PCT/CN2010/076122, filed on Aug. 19, 2010, both of which are incorporated herein by reference in their entireties, for any and all purposes.

BACKGROUND

Unless otherwise indicated herein, the materials described in this section are not prior art to the claims in this application and are not admitted to be prior art by inclusion in this section.

Paved road is an important part of infrastructure. Tar, asphalt, and other petroleum derivatives are traditionally used as paving materials. Petroleum derived paving materials are not always locally available and often have to be transported to where they are needed. It is therefore not economical and not environmental friendly to use petroleum derived paving materials in some circumstances. Petroleum is also being depleted. Thus, there is a need to find alternative paving materials and paving methods.

SUMMARY

In one or more embodiments of the present disclosure, a paver includes an enclosed furnace for melting an inorganic paving material and a carriage for carrying the furnace. The furnace includes a heating chamber for receiving the paving material, a heater for heating the heating chamber to a temperature greater than 1,600° C. to melt the paving material, and an outlet for discharging melted paving material to form a paved road surface.

In one or more embodiments of the present disclosure, a method for paving includes moving along a path, while moving, melting an inorganic paving material with a temperature of at least 1600° C., and applying the melted paving material over a surface along the path.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
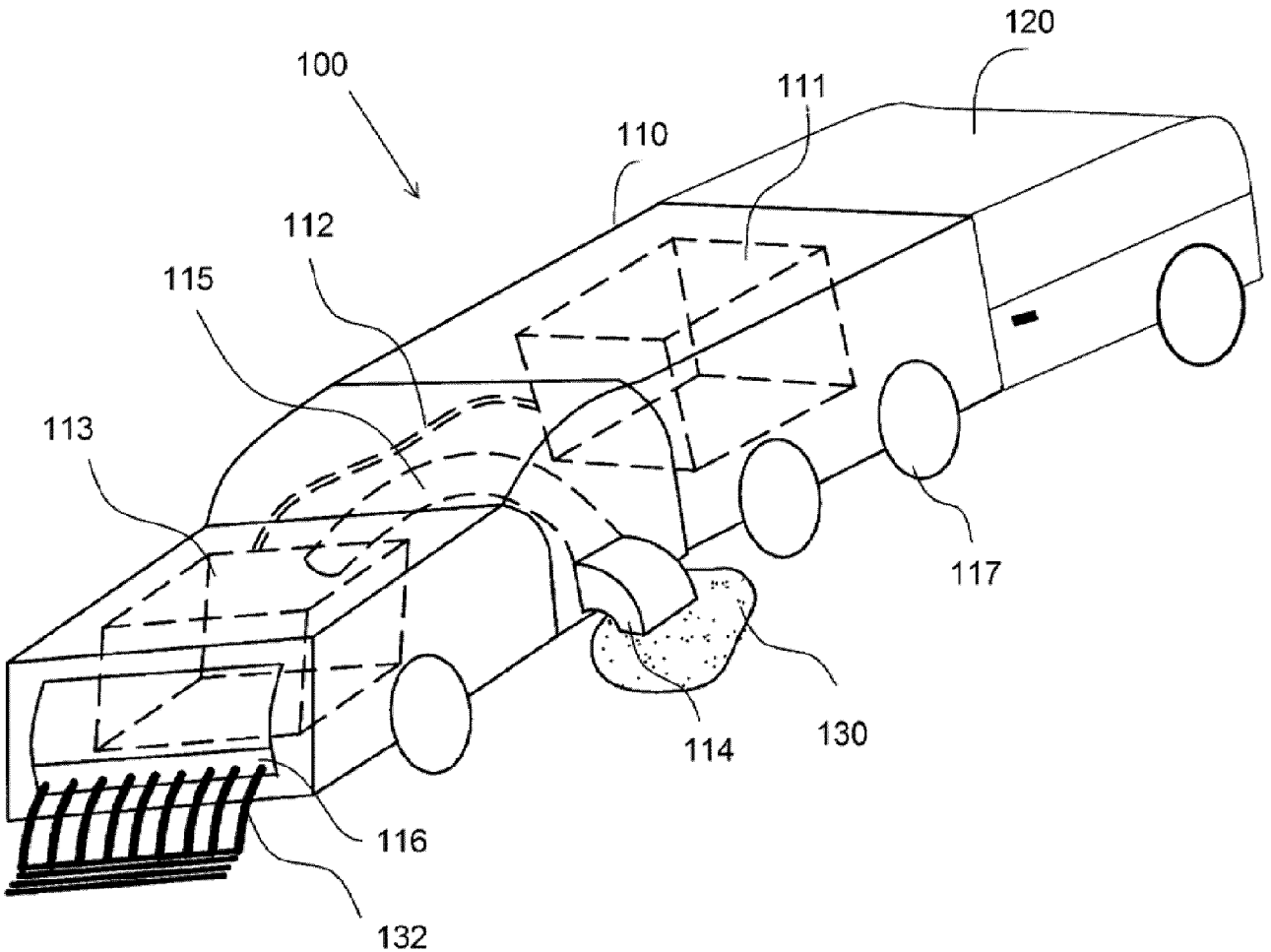
FIG. 1 shows a perspective view of an illustrative paver.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is drawn, inter alia, to systems, devices, methods, and techniques related to paving a road with inorganic paving materials.

Instead of using non-local paving materials that have to be transported to a job site, local materials such as sand, soil, and gravel that are part of the surface to be paved are used as inorganic paving materials. The inorganic paving materials are melted under high temperature to form part or the entire road surface after they solidify. In addition to paving roads, the inorganic paving materials may be used to form canals, drains, dams, levees, and other civil structures. Sand as an inorganic paving material is of particular interest as it is abundant in desert and seaside areas where sand often has to be immobilized.

FIG. 1 shows a perspective view of an illustrative paver 100 in one or more embodiments of the present disclosure. The paver 100 includes a carriage 110 that is pulled by a tractor 120 integrated with or independent from the paver 100. The carriage 110 includes a power supply 111, a supply cable 112, a furnace 113, a paving material inlet 114, a paving material conduit 115, a paving material outlet 116, and wheels 117. A paving material 130 and a melted paving material 132 are also shown in the figure.

The paving material 130 enters the paving material inlet 114, travels down the paving material conduit 115, and enters the furnace 113. The paving material inlet 114 may include a feeder having an excavator that gathers the paving materials 130 from the ground surface alongside the paver 100. The paving material conduit 115 may include a conveyor that transports the paving material 130 to the furnace 113.

The furnace 113 melts the paving material 130. In one or more embodiments, the furnace 113 has a plasma heater that supplies the heat to melt the paving material 130. Alternatively the furnace 113 has another type of heater, such as a fossil fuel powered heater, a solar heater, an electric heater, or a nuclear heater. The power supply 111 supplies electricity or fossil fuel via the supply cable 112 to the heater in the furnace 113.

The furnace 113 discharges the melted paving material 132 through the paving material outlet 116 to form a paved road surface. Although not shown, the paver 100 may include a screed or a roller trailing the paving material outlet 116 to level the melted paving material 132. The wheels 117 allow the paver 100 to travel over various terrains. Alternatively the paver 100 may be equipped with tracks.

In operation, the paver 100 travels over a path to be paved. The paving material 130 alongside the paver 100 are gathered by the paving material inlet 114 and fed to the furnace 113. The melted paving material 132 is discharged from the paving material outlet 116 over the path to form a paved road surface.

The paving material 130 may be one or more inorganic materials along the paving path such as sand, soil, and gravel. These inorganic materials have much higher melting temperatures than the petroleum derived paving materials. A major component of sand is silicon dioxide, which has a melting point of about 1,750° C. Major components of soil and gravel include silicon oxide ($SiO_2$), iron oxides ($Fe_2O_3$, $Fe_3O_4$), aluminum oxide ($Al_2O_3$), magnesium oxide (MgO), calcium oxide (CaO), other oxides, silicides thereof and/or phosphates thereof. The melting points of $Fe_2O_3$, $Fe_3O_4$, $Al_2O_3$, MgO, and CaO are about 1,565° C., 1,538° C., 2,050° C., 2,852° C., and 2,580° C., respectively. Generally the furnace 113 operates at a temperature about a range from the lowest melting temperature to the highest melting temperature of the components in the paving material 130 (e.g., from 1,600 to 2,900° C.). When the furnace 113 operates at the lower end of the range, then less than all of the components of the paving material 130 is melted but embedded in the resulting paved road surface. This may help to save energy.

In one or more embodiments, a reinforcing steel bar ("rebar") structures is laid down and covered by the melted paving material 132. The rebar structures may be protected by a heat-resistant outer cover from the melted paving material 132.

In one or more embodiment, a foaming component is added to the paving material 130 to provide a bubble structure to the melted paving material 132. The foaming component may be used to reduce raw material consumption, and to adjust the density and increase the flexibility of the melted paving material 132. A suitable foaming component is limestone, which releases carbon dioxide when melted to form the bubble structure in the melted paving material 132. Alternatively air may be added to the melted paving material 132.

In one or more embodiment, the melted paving material 132 is mechanically stirred repeatedly in the furnace 113. This may help to strengthen the melted paving material 132 when it solidifies. Alternatively, an ultrasonic agitator, a blower, or uneven heating within the furnace 113 may be used to mix the melted paving material 132.

Figure 2:
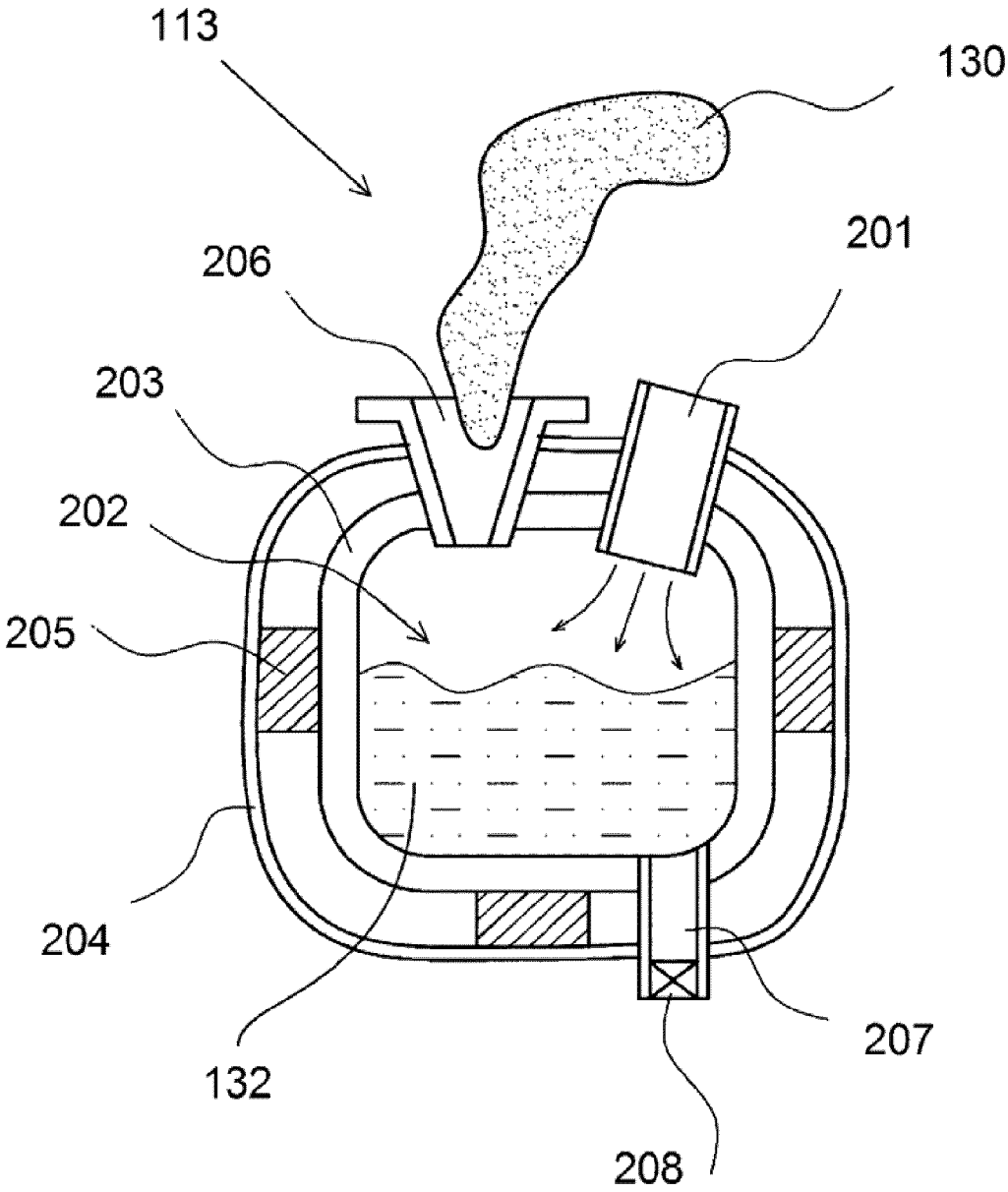
FIG. 2 shows a cross-sectional view of an illustrative furnace in the paver of FIG. 1.

FIG. 2 shows a cross-sectional view of an illustrative furnace 113 in the paver of FIG. 1 in one or more embodiments of the present disclosure. The furnace 113 comprises a heater 201, a heating chamber 202, an inner wall 203, an outer wall 204, a heat insulating layer 205, a paving material inlet 206, a paving material outlet 207, and a paving material outlet valve 208. The paving material 130 and the melted paving material 132 are also shown in the figure.

The heater 201 is coupled by the supply cable 112 (FIG. 1) to the power supply 111 (FIG. 1). As described above, the heater 201 may be a plasma heater including a plasma generator, a gas feeder, and a nozzle. There are several electrical and chemical methods for producing plasma, such as by DC arc discharge, AC power frequency discharge, high frequency induction discharge, low pressure discharge and combustion methods. Among arc plasma generators, power frequency arc plasma generators, high frequency induction plasma generators, low pressure plasma generators, and combustion plasma generators, the arc plasma generators, the high frequency induction plasma generators, and the low pressure plasma generators are commonly utilized. In one or more embodiments of the present disclosure, the high frequency induction plasma generator is adopted. The high frequency induction plasma generator hasinduction coils instead of electrodes and therefore are free from the electrode aging problem. Of course, other types of plasma generators are also applicable. The heater 201 melts the paving material 130 to form the melted paving material 132 in the heating chamber 202.

The heating chamber 202 is enclosed by the inner wall 203 and then the outer wall 204. The inner wall 203 and the outer wall 204 are heat-resistant in the operating temperatures of the furnace 113. Suitable materials for the inner wall 203 and the outer wall 204 may include metals, metal alloys, magnesium limestone bricks, zirconium bricks, and corundum bricks. The heat insulating layer 205 between the inner wall 203 and the outer wall 204 reduces heat loss from the heating chamber 202. The heating insulating layer 205 may be a vacuum or a suitable thermal insulating material.

The paving material inlet 206 feeds the paving material 130 into the heating chamber 202. The melted paving material 132 is discharged from the paving material outlet 207. The paving material outlet valve 208 controls the discharge rate of the melted paving material 132 from the paving material outlet 207. The paving material outlet 207 of the furnace 113 is coupled to the paving material outlet 116 (FIG. 1) of the paver 100 (FIG. 1).

Figure 3:
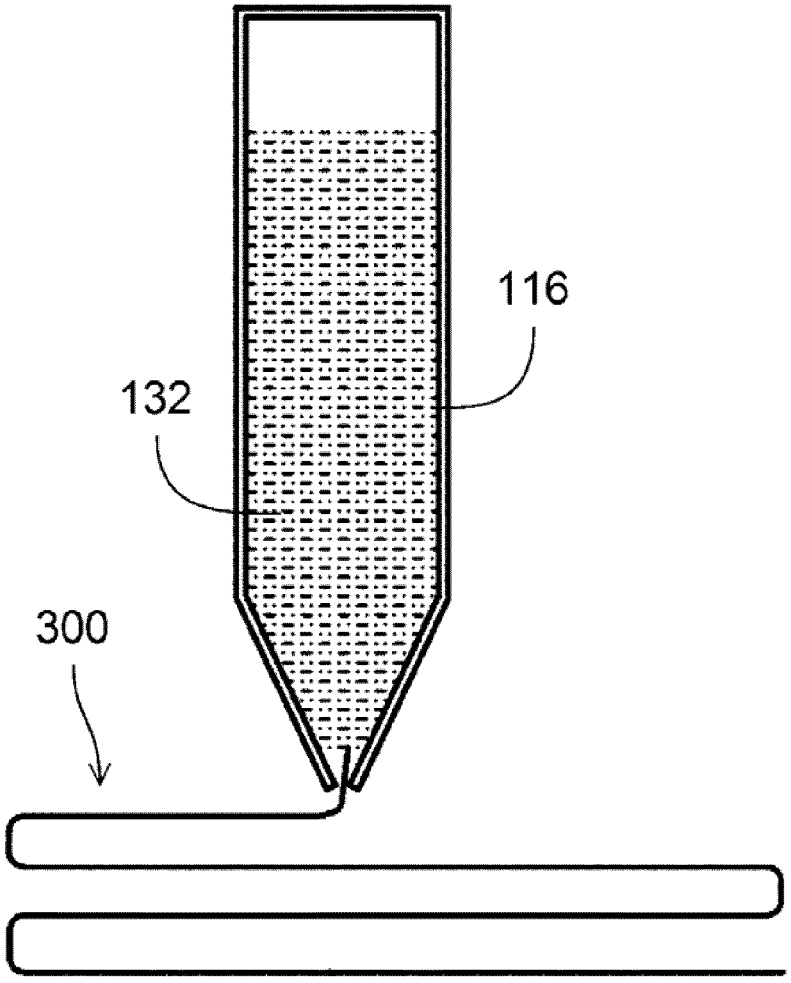
FIG. 3 shows an illustrative pattern made of melted paving materials for forming a road surface.

FIG. 3 shows an illustrative pattern 300 made of the melted paving material 132 for forming a paved road surface in one or more embodiments of the present disclosure. The pattern 300 includes fine, substantially parallel lines of the melted paving material 132. The small dimensions of the lines allow the melted paving material 132 to quickly solidify. To form this pattern, the paving material outlet 116 is small and it is mechanically moved back and forth as the paver 100 moves incrementally forward. Of course other patterns, such as zigzags, can be generated.

Figure 4:
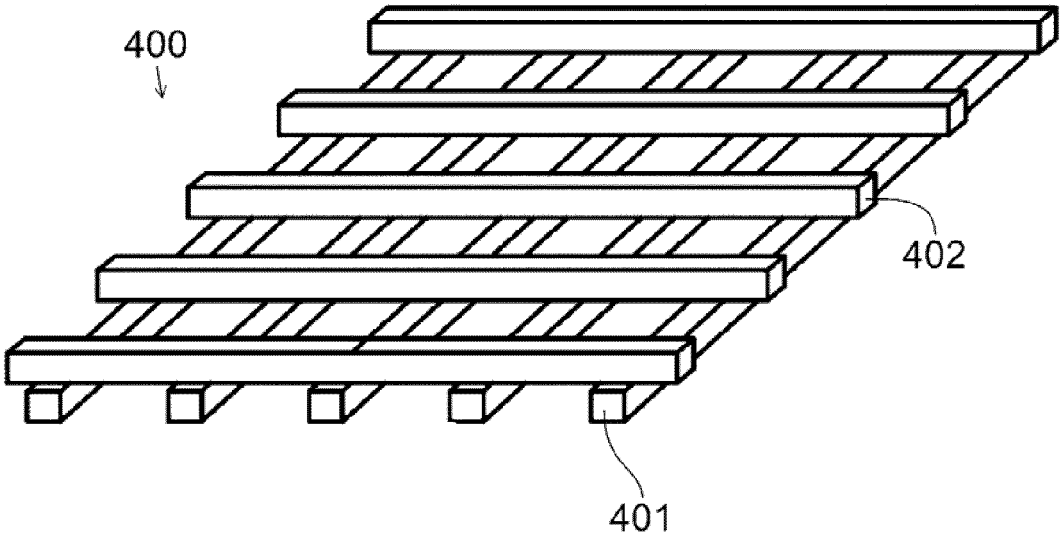
FIG. 4 shows an illustrative pattern made of melted paving materials for forming a reinforcing structure for another paving material.

FIG. 4 shows an illustrative pattern 400 made of the melted paving material 132 for forming for a reinforcing structure for another paving material in one or more embodiments of the present disclosure. The pattern 400 includes a lower layer 401 of substantially parallel bars aligned along a first direction, and an upper layer 402 of substantially parallel bars aligned along a second direction substantially perpendicular to the first direction. To form this pattern, the paving material outlet 116 is mechanically moved back and forth along the first direction to form the lower layer 401. After the lower layer 401 solidifies, the paving material outlet 116 is mechanically moved back and forth along the second direction to form the upper layer 402. After the upper layer 402 solidifies, another paving material is applied over the pattern 400. The pattern 400 increases the strength and endurance of the paved road surface like rebar structures in reinforced concrete.

Figure 5:
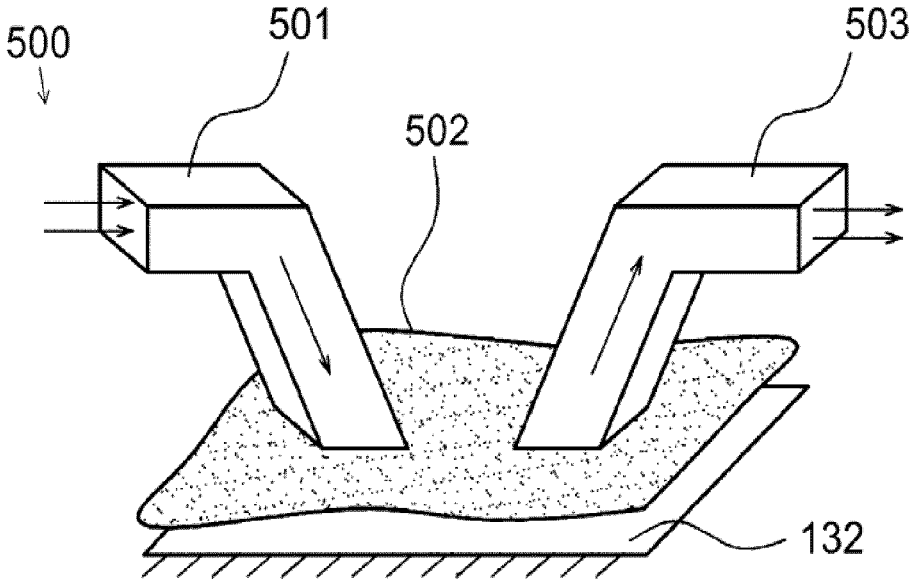
FIG. 5 shows a perspective view of an illustrative preheater in the paver of FIG. 1.

FIG. 5 shows a perspective view of an illustrative preheater 500 for the paver 100 of FIG. 1 in one or more embodiments of the present disclosure. The preheater 500 includes an inlet 501, a heat exchanger 502, and an outlet 503. The heat exchanger 502 may be a heat conductive pouch. The paving material 130 is fed through the inlet 501 into the heat exchanger 502. The heat exchanger 502 is in contact with the melted paving material 132 discharged from the paving material outlet 116 (FIG. 1) to recover and recycle heat. The paving material 130 is heated in the heat exchanger 502 and then removed through the outlet 503. The preheater 500 may be located before the paving material inlet 114 (FIG. 1) or form part of the paving material conduit 115 (FIG. 1). In other embodiments, the heat exchanger 502 may also be thermally coupled to the heating chamber 202 (FIG. 2) or the paving material outlet 207 (FIG. 2) to recover and recycle heat.

In one or more embodiments of the present disclosure, the paver 100 includes a pattern making device that forms a desired pattern on the melted paving material 132. The pattern helps to increase vehicle traction on the paved road surface. The paver 100 may drag the pattern making device over the melted paving materials 132. For example, the pattern making device may be a plate, a screed, or a roller equipped with projections, depressions, or other patterns.

In some embodiments, the pattern making device can be integrated with the preheater 500. For example, the lower side of the heat exchanger 502 may include projections or depressions. When the heat exchanger 502 moves over the melted paving materials 132, the projections or the depressions inscribe patterns on the paved road surface.

Figure 6:
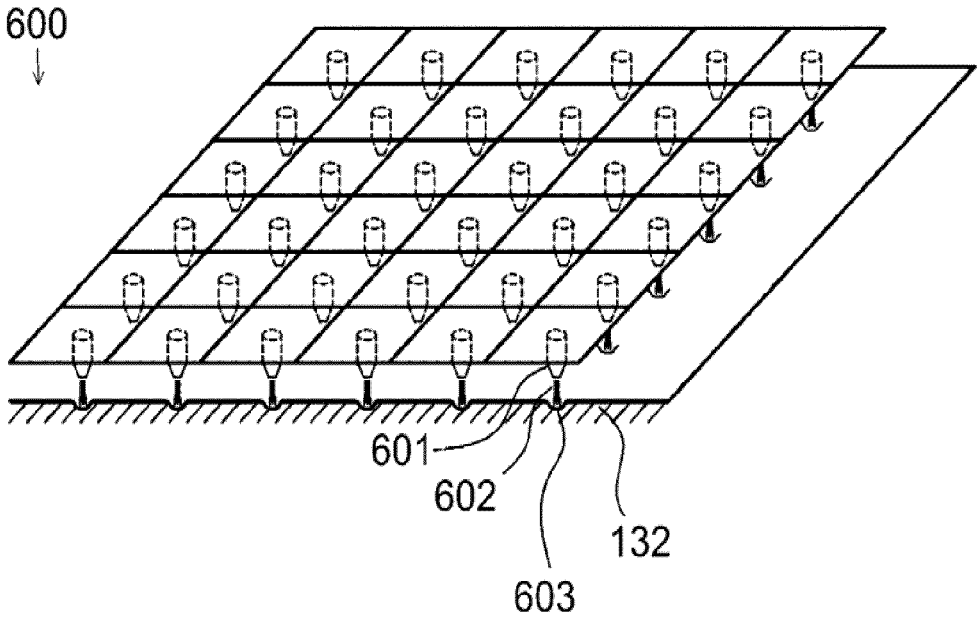
FIG. 6 shows a perspective view of an illustrative array of air nozzles in the paver of FIG. 1.

FIG. 6 shows a perspective view of an illustrative array of air nozzles 600 in the paver 100 of FIG. 1 in one or more embodiments of the present disclosure. The air nozzles 600 are used as a pattern making device. The air nozzles 600 are located behind the paving material outlet 106 (FIG. 1). The air nozzles 600 spray bursts of air on the top surface of the melted paving material 132 before it solidifies. The bursts of air create a desired pattern 603 on the paved road surface, such as a dotted pattern, a lined pattern, or another similar pattern. The pattern 603 increases vehicle traction on the paved road surface.

Figure 7:
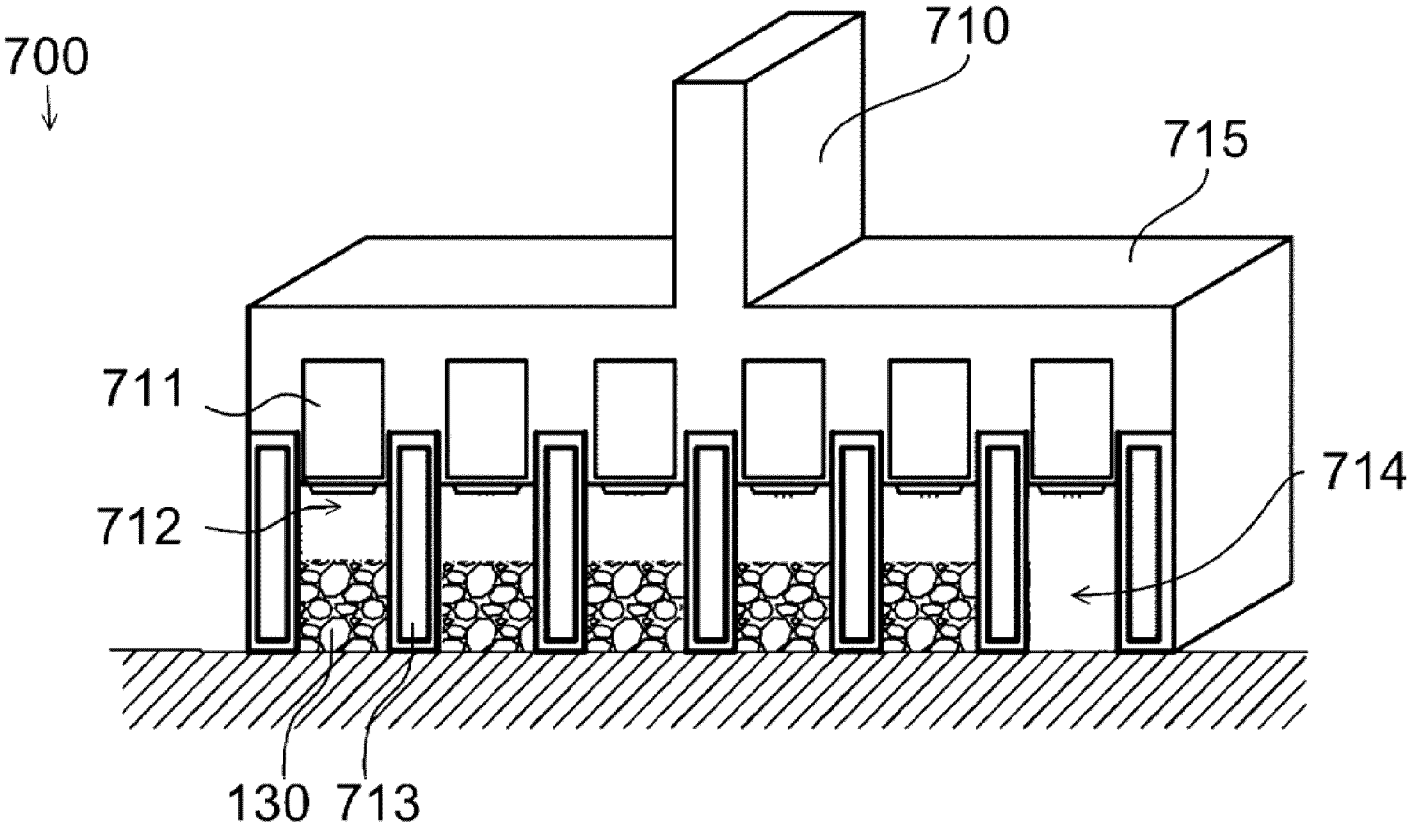
FIG. 7 shows a cross-sectional view of part of another illustrative paver, all arranged in accordance with at least some embodiments described herein.

FIG. 7 shows a perspective view of an illustrative paver 700 in one or more embodiments of the present disclosure. The paver 700 includes a furnace 710 and a tractor (not shown). The furnace 710 has plasma heaters 711, heating chambers 712, insulating walls 713, integrated inlets/outlets 714, and a carriage 715. The paver 700 may further include wheels for the carriage 715 and a power supply for the plasma heater 711, which are not shown in the figure. The paving material 130 is also shown in the figure.

The heating chambers 712 are separated by the insulating walls 713. The plasma heaters 711 are located above the heating chambers 712. Alternatively another suitable type of heaters described above may be used. The integrated inlets/outlets 714 form bottom openings to the heating chambers 712.

The furnace 710 is pressed down into the paving material 130 so the heating chambers 712 receive the paving materials 130 through the integrated inlets/outlets 714. The plasma heaters 711 heat the paving material 130 in the heating chambers 712. After the paving material 130 are melted, the furnace 710 is lifted and moved to the next location to be paved.

The tractor of the paver 700 may have a mechanical arm for lowering and lifting the furnace 710. The paver 700 may also include the above mentioned leveling device and pattern making device.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediate components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

I claim:

1. A method for paving, the method comprising:

moving a paver along a path;

while moving the paver along the path, heating an inorganic paving material to a temperature of at least approximately 1600 degrees Celsius;

applying the heated inorganic paving material over a surface along the path; and preheating additional paving material with heat recovered from the applied inorganic paving material using a preheater, wherein the preheater comprises a heat exchanger in physical contact with the applied inorganic paving material.

2. The method of claim 1, wherein the heating comprises generating a plasma to heat the inorganic paving material.

3. The method of claim 1, further comprising while moving the paver along the path, extracting the inorganic paving material from a location alongside the path.

4. The method of claim 3, wherein the inorganic paving material comprises sand.

5. The method of claim 3, further comprising transporting, via a conveyor, the extracted inorganic paving material to a furnace in the paver.

6. The method of claim 1, further comprising heating the additional paving material to a temperature of at least approximately 1600 degrees Celsius after the preheating the additional paving material.

7. The method of claim 1, further comprising preheating additional paving material with heat recovered from the heating the inorganic paving material.

8. The method of claim 1, wherein heating the inorganic paving material comprises using one of a fossil fuel powered heater, a solar heater, an electric heater, and a nuclear heater.

9. The method of claim 1, wherein the inorganic paving material includes at least one of silicon dioxide, iron oxides, aluminum oxide, magnesium oxide, calcium oxide, silicides thereof, and phosphates thereof.

10. The method of claim 1, further comprising while moving the paver along the path, discharging the heated inorganic paving material back and forth along one or more directions.

11. The method of claim 10, further comprising discharging another heated inorganic paving material over the applied inorganic paving material, wherein the applied inorganic paving material acts as a reinforcing structure for the discharged heated inorganic paving material.

12. The method of claim 1, further comprising patterning a top surface of the applied inorganic paving material.

13. The method of claim 1, wherein the heating the inorganic paving material comprises melting the inorganic paving material.

14. The method of claim 1, further comprising adding a foaming component to the inorganic paving material.

15. The method of claim 1, further comprising leveling the applied inorganic paving material via a screed on the paver.

16. The method of claim 1, wherein the paver is self-propelled.

17. The method of claim 1, wherein the paver comprises an excavator, the method further comprising excavating the inorganic paving material via the excavator.

18. The method of claim 1, wherein the heating an inorganic paving material is performed by a furnace comprising a feeder, and wherein the preheater is configured to heat the additional paving material on the feeder.

* * * * *